US005644353A

United States Patent [19]

Sarraf

[11] Patent Number: 5,644,353

[45] Date of Patent: *Jul. 1, 1997

[54] APPARATUS AND METHOD FOR ELIMINATING FEEDBACK NOISE IN LASER THERMAL PRINTING

[75] Inventor: Sanwal Prasad Sarraf, Pittsford, N.Y.

[73] Assignee: Eastman Kodak Company, Rochester, N.Y

[ * ] Notice: The term of this patent shall not extend beyond the expiration date of Pat. No. 5,420,611..

[21] Appl. No.: 368,561

[22] Filed: Jan. 4, 1995

Related U.S. Application Data

[63] Continuation-in-part of Ser. No. 905,948, Jun. 29, 1992, Pat. No. 5,420,611.

[51] Int. Cl.[6] ..... B41J 2/435; B41J 2/48

[52] U.S. Cl. ..... 347/224; 347/225; 347/171

[58] Field of Search ..... 347/171, 224, 347/225

[56] References Cited

U.S. PATENT DOCUMENTS 5,258,776 11/1993 Guy et al. ..... 347/224

5,420,611 5/1995 Sarraf ..... 347/215

*Primary Examiner*—Huan H. Tran

*Attorney, Agent, or Firm*—Nelson Adrian Blish

[57] ABSTRACT

An apparatus and method are provided for forming a laser-induced thermal dye transfer image. A slide for brings a dye donor and dye receiver into dye transferring proximity, and a laser emits a beam of light toward the donor to image-wise transfer dye to the receiver. The slide, along with the donor therein, is tilted to eliminate intensity noise in the laser caused by light reflecting from the slide and donor back to the laser. By tilting the slide, specular reflections from the dye donor do not intercept optical path and do not propagate along the optical path.

13 Claims, 1 Drawing Sheet

APPARATUS AND METHOD FOR ELIMINATING FEEDBACK NOISE IN LASER THERMAL PRINTING

CROSS-REFERENCE TO RELATED APPLICATION

This application is a continuation-in-part of my U.S. patent application entitled "APPARATUS AND METHOD FOR ELIMINATING FEEDBACK NOISE IN LASER THERMAL PRINTING", filed on Jun. 29, 1992, assigned Ser. No. 07/905,948 which issued as U.S. Pat. No. 5,420,611 on May 30, 1995.

TECHNICAL FIELD OF THE INVENTION

The present invention relates generally to laser thermal printing, and, more particularly, to an apparatus and method for eliminating artifacts caused by feedback noise created by light reflected along the optical path from the donor and optical components to the laser.

BACKGROUND OF THE INVENTION

Laser feedback noise is a concern in laser printing systems and other systems, such as optical disks, for example, because it affects print quality by causing artifacts. Accordingly, it will be appreciated that it would be highly desirable to eliminate artifacts in laser thermal images caused by the intensity noise of the laser due to reflected light feeding back to the laser cavity.

A variety of methods are used to eliminate the noise, or, at the very least, significantly reduce the noise. One way is to exploit the polarization characteristics of diode lasers. More than 90 percent of the radiation emitted by a diode laser is linearly polarized and passes through a half-wave plate where it rotates by 90°. The rotated beam is transmitted by a beam polarizer to a quarter-wave plate which has a crystalline axis oriented at 45° from the plane of polarization. The quarter-wave plate converts the linearly polarized light into circularly polarized light. The specular reflections are also circularly polarized but with opposite direction, and are extinguished upon their return to the polarizer. While wave plates and polarizers are effective, they are also expensive, difficult to align and diminish the effective power of the laser. Any lost power adversely effects the printing speed which is undesirable. Accordingly, it will be appreciated that it would be highly desirable to eliminate intensity noise of the laser without employing expensive components or components difficult to align. It is also deskable to eliminate intensity noise without sacrificing the available power of the laser.

SUMMARY OF INVENTION

The present invention is directed to overcoming one or more of the problems set forth above. Briefly summarized, according to one aspect of the invention, a method for forming a laser-induced thermal dye transfer image comprises bringing a dye donor into dye transferring proximity to a receiver, heating the donor by a laser which is incident upon the surface of the donor at a non-zero angle, transferring dye from the donor to the receiver and forming a laser-induced thermal dye transfer image. By tilting the donor at an angle from the normal, intensity noise in the laser caused by light reflecting from the donor back to the laser is eliminated.

The donor is tilted at an angle to the incoming beam so that the beam is deflected away from the donor in a direction not coincident with the incoming beam without a loss of laser power.

According to another aspect of the invention, an apparatus for forming a laser-induced thermal dye transfer image comprises a media-carrying member such as a slide or rotating drum for bringing a dye donor element into dye transferring proximity to a dye receiver element with the dye donor receiving light projected along an optical path. The donor surface is tilted relative to the optical path to eliminate intensity noise in the laser caused by light reflecting from the slide and donor back to the laser. By tilting the donor surface at a non-zero angle from the normal, specular reflections from the dye donor do not intercept the optical path and do not propagate along the optical path.

These and other aspects, objects, features and advantages of the present invention will be more clearly understood and appreciated from a review of the following detailed description of the preferred embodiments and appended claims, and by reference to the accompanying drawing.

DETAILED DESCRIPTION OF THE PREFERRED EMBODIMENTS

Figure 1:
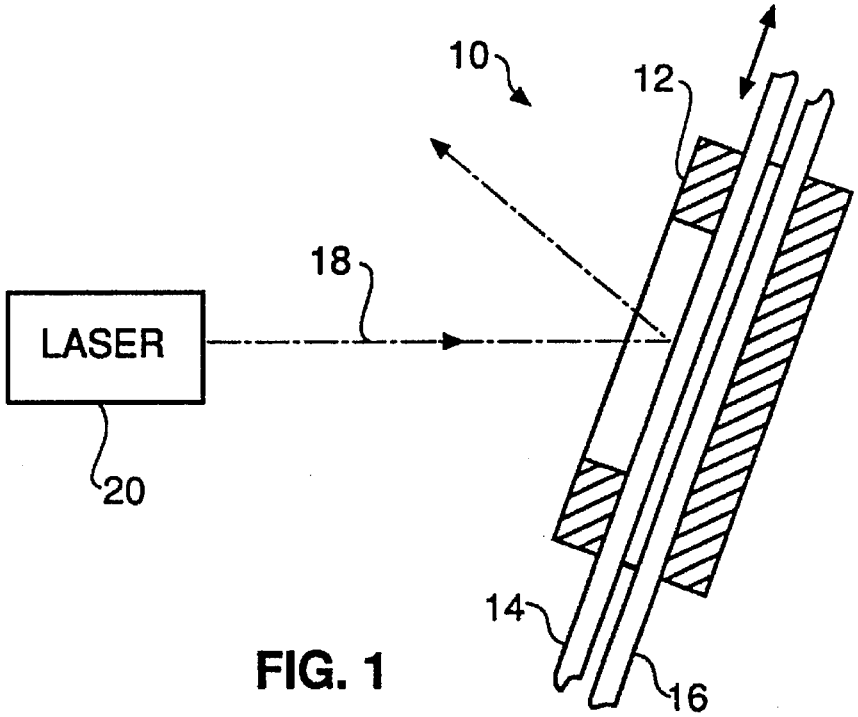
FIG. 1 is a diagram of a preferred embodiment of laser thermal printing apparatus with the dye donor tilted in accordance with the present invention.

Referring to FIG. 1, a laser imaging apparatus 10 is illustrated for forming a laser-induced thermal dye transfer image. The apparatus includes a slide 12 for bringing a dye donor element 14 into dye transferring proximity to a dye receiver element 16. The dye donor 14 comprises a support having a dye layer thereon and an infrared-absorbing material. The dye receiver element 16 comprises a support having a polymeric dye image-receiving layer thereon.

A media-carrying member such as slide 12 preferably has two openings. One opening receives the donor 14, and the other opening admits a beam of light 18 to scan the donor 14. The slide 12 holds the donor 14 in close proximity to the receiver 16, but maintains a gap therebetween to physically separate the donor 14 and receiver 16. The slide 12, which acts as a film holder, may be mounted on a translation stage or may be part of a translation stage so that the donor-receiver pair can be scanned across by the laser beam 18 in one direction. Physical separation improves print quality by preventing the donor 14 from sticking to the receiver 16. Physical separation may be achieved, for example, by spacer beads which are well known in the art as indicated in U.S. Pat. No. 5,017,547.

The slide 12 brings the dye donor element 14 into dye transferring proximity to the dye receiver element 16 so that the donor 14 receives the beam of light 18 projected along the optical path. The slide 14 is tilted at an angle with respect to the incoming beam 18 to eliminate intensity noise caused by light reflecting from the dye donor 14 along the optical path. The slide 12 is movable, relative to the beam 18, while tilted at a non-zero angle, so tilted to scan the donor 14 across the beam 18 in a page scan direction as indicated by the arrow.

A laser 20 emits the beam of light 18 along an optical path towards the dye donor 14 to heat the donor 14. Heating causes an image-wise transfer of dye from the dye donor 14 to the dye receiver 16 to thereby form a laser-induced thermal dye transfer image. The laser 20 is preferably a diode laser. Ordinarily, laser radiation from donor 14, receiver 16 and other optical components can be reflected back to the laser 20 and create intensity noise, but the donor 14 and the media-carrying member are not perpendicular to the incoming beam 18 so that light is not reflected back along the optical path.

Operation of the present invention is believed to be apparent from the foregoing description, but a few words will be added for emphasis. The problem of intensity noise can be reduced somewhat by coating the optical components with a non-reflective coating, but the reflection from the donor and receiver elements still remains a problem. With the present invention, the problem of intensity noise is solved by tilting the media-carrying member such as slide 12 at an angle so that any remaining specular reflections from the donor and receiver elements do not intercept the optical path to cause intensity noise. The slide is oriented at an angle to the incoming beam so that the beam is deflected in a direction not coincident with the incoming beam.

It can now be appreciated that there has been disclosed an apparatus and method for forming a laser-induced thermal dye transfer image. The method includes contacting a dye donor element with a dye receiving element and physically separating the dye donor and dye receiver by a finite distance using spacers while maintaining dye transferring proximity. The method includes image-wise heating the dye donor element by means of a laser and transferring a dye image to the dye receiving element to form a laser-induced thermal dye transfer image. The method also includes tilting the dye donor and thereby eliminating reflections back to the laser. Intensity noise in the laser caused by reflections from the donor film plane, called feedback noise, is eliminated by tilting the donor film plane and thereby eliminating reflections back to the laser cavity.

Figure 2:
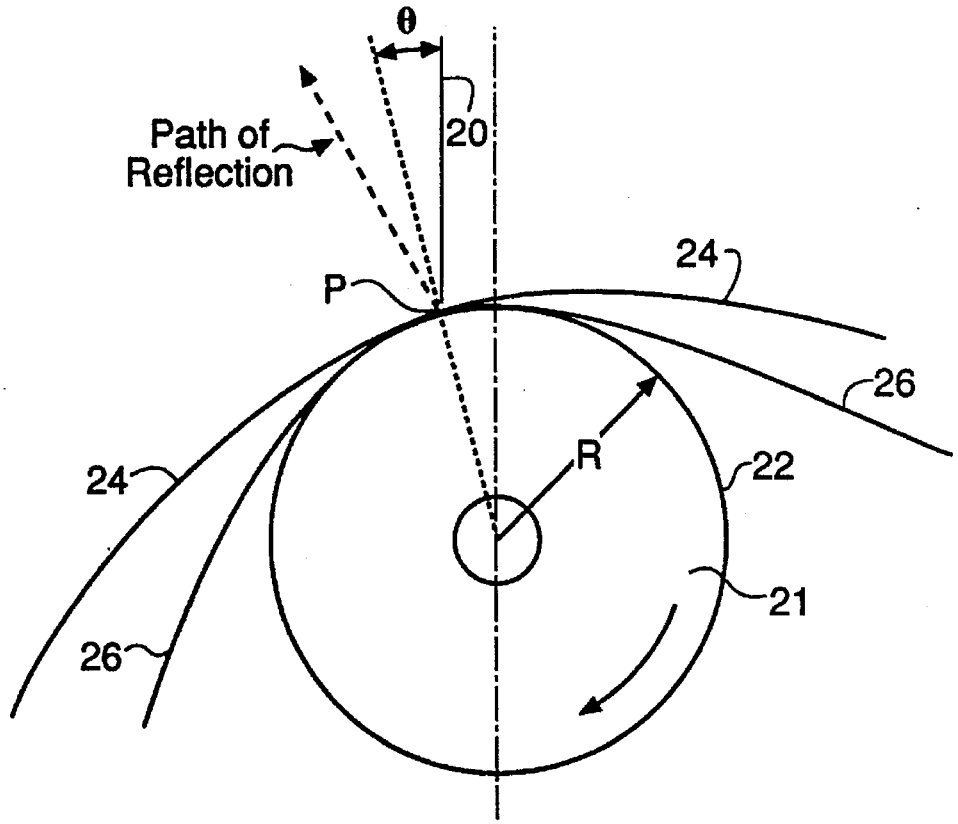
FIG. 2 illustrates an enlarged view of a media-carrying member showing the laser light beam incident on a drum at a non-normal angle of incidence where the dye donor element is proximate the dye receiver element.

FIG. 2 shows a beam of modulated laser light 20 striking the surface of a media-carrying member such as the surface 22 of drum 21 at a non-zero angle θ, thereby causing the reflected light to be harmlessly reflected along the dotted path. Angle θ is measured between incident beam 20 and a plane which includes the axis of the drum and the point of beam incidence p. This non-zero to normal angle of incidence θ is enabled by positioning a scanning laser beam or plurality of fixed independently modulated lasers at an offset with respect to the drum 21.

A donor web 24 and receiver web 26 may be trained over a portion of the surface 22 of the drum 21 with the two webs being brought into close proximity with one another at the point on the surface of the drum that intersects the optical path of the laser light beam. The two webs would be in close proximity, but would be separated by using spacer beads as mentioned earlier.

Alternatively, a dye donor element and a dye receiver element could be held on the surface of the drum by clamps and/or vacuum devices (not shown). The laser light beam would be scanned across the surface of the drum in the line direction and the rotation of the drum would provide the page direction.

While the invention has been described with particular reference to the prefected embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

The present invention eliminates laser feedback noise without using expensive optical elements or suffering a loss of power. A simple solution is provided that requires tilting the image plane so that the reflected light is not coincident with the optical path and never makes it back to the laser. Because most of the optical elements are appropriately coated for anti-reflection, the major portion of specular reflection is from the donor film, and, by tilting the film platen, the specular reflection is eliminated.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. An apparatus for forming a laser-induced thermal dye transfer image, said apparatus comprising:

a laser for projecting a light beam along an optical path; and a media-carrying member having a surface for providing a location at which a dye donor element is brought into dye transferring proximity with a dye receiver element and for receiving said light beam at a point of incidence, wherein a direction normal to the surface of the media-carrying member at the point of incidence differs from the optical path, to eliminate intensity noise caused by light reflecting from the dye donor element along the optical path.

2. The apparatus of claim 1, further comprising means for moving said media-carrying member relative to said light beam, to scan the light beam across the dye donor element in a page scan direction.

3. An apparatus for forming a laser-induced thermal dye transfer image, comprising:

media-carrying member having a surface for providing a location at which a dye donor element is brought into a dye transferring proximity to a dye receiver element; and a laser emitting a beam of light toward said dye donor element to imagewise transfer dye from said dye donor element to said dye receiver element to form a laser-induced thermal dye transfer image, wherein the beam of light emitted by the laser defines a direction toward a point of incidence on the surface of the media-carrying member at a non-zero angle from a direction normal to the surface at the point of incidence, for eliminating intensity noise in the laser caused by light reflected from the dye donor element back toward the laser.

4. The apparatus of claim 3, further comprising means for moving the media-carrying member relative to said beam of light, to scan the beam of light across the dye donor element in a page scan direction.

5. The apparatus of claim 3, wherein the beam of light emitted from said laser travels along an optical path to said dye donor element, and wherein said direction normal to said surface of said media-carrying member differs from the optical path so that specular reflections from the dye donor element do not intercept the optical path.

6. The apparatus of claim 3, wherein the beam of light emitted from said laser travels along an optical path to said dye donor element and said media-carrying member, and wherein said direction normal to said surface of said media-carrying member defines an angle with the optical path so that specular reflections from the dye donor element do not intercept the optical path.

7. A method for forming a laser-induced thermal dye transfer image, comprising the steps of:

bringing a dye donor element into dye transferring proximity with a dye receiver element at a surface of a media-carrying member;

heating said dye donor element by a laser emitting a beam of light having an optical path which defines a point of incidence with the surface;

transferring dye from said dye donor element to said dye receiver element and forming a laser-induced thermal dye transfer image; and angling the surface of the media-carrying member such that a direction normal to the surface at the point of incidence deviates from the optical path for eliminating intensity noise in the laser caused by light reflecting from the dye donor element back to the laser.

8. The method of claim 7, further including a step of separating said dye donor element and dye receiver element from each other by a finite distance.

9. The method of claim 7, further including a step of:

angling the surface of the media-carrying member so that specular reflections from the dye donor element do not intercept the optical path.

10. The method of claim 7, further including a step of:

angling the surface of the media-carrying member relative to the beam of light such that the angle of incidence of the beam of light deviates from a direction normal to the surface at the point of incidence so that specular reflections from the dye donor element are not directed along the optical path toward the laser.

11. An apparatus for forming a laser-induced thermal dye transfer image comprising:

a beam of laser light projected along an optical path;

a rotating drum having a surface wherein the beam of laser light is incident at the surface of the rotating drum, thereby defining a point of incidence, at an angle of incidence which deviates from a direction normal to the surface defined at the point of incidence;

a web of dye receiver material being trained about a portion of the surface of said rotating drum; and a web of dye donor material being trained in overlying relation to said web of dye receiver material and a portion of the surface of said rotating drum, said web of dye donor material being in dye transferring proximity to said web of dye receiver material at the point of incidence of said beam of laser light.

12. An apparatus for forming a laser-induced thermal dye transfer image comprising:

a beam of modulated laser light projected along an optical path;

a rotating drum having a circumference and being positioned in the optical path of said beam of modulated laser light so that the beam is incident with a surface of the rotating drum at a point of incidence wherein an angle of incidence q of the beam at the surface of the rotating drum deviates from a direction normal to the surface defined at the point of incidence, wherein the angle of incidence q is measured between a plane including the axis of the drum and the point of incidence and the beam of modulated laser light;

a web of dye receiver material trained around a portion of the circumference of said rotating drum; and a web of dye donor material overlying said web of dye receiver material around a portion of the circumference of said rotating drum such that said web of dye donor material is in transferring proximity to said web of dye receiver material at the point of incidence of said modulated beam of laser light.

13. (amended) The apparatus of claim 12 wherein the angle of incidence q with respect to the surface of the drum is greater than 0.

* * * * *